US010080449B2

(12) United States Patent
Jhou

(10) Patent No.: US 10,080,449 B2
(45) Date of Patent: Sep. 25, 2018

(54) MATTRESS PROTECTOR AND METHOD TO WRAP A MATTRESS WITH THE SAME

(71) Applicant: JUN HONG CORPORATION, Tainan (TW)

(72) Inventor: Wun-Jyun Jhou, Tainan (TW)

(73) Assignee: Jun Hong Corporation, Tainan (TW)

( * ) Notice: Subject to any disclaimer, the term of this patent is extended or adjusted under 35 U.S.C. 154(b) by 200 days.

(21) Appl. No.: 14/931,977

(22) Filed: Nov. 4, 2015

(65) Prior Publication Data

US 2016/0128499 A1 May 12, 2016

(30) Foreign Application Priority Data

Nov. 10, 2014 (TW) ..... 103138954 A

(51) Int. Cl.
*A47G 9/02* (2006.01)
*A47C 27/00* (2006.01)
*A47C 31/10* (2006.01)

(52) U.S. Cl.
CPC ..... *A47G 9/0292* (2013.01); *A47C 27/008* (2013.01); *A47C 31/105* (2013.01)

(58) Field of Classification Search
CPC ... A47C 27/002; A47C 27/008; A47C 31/105; A47G 9/0292
See application file for complete search history.

(56) References Cited

U.S. PATENT DOCUMENTS 3,286,284 A * 11/1966 Klogether ..... A47C 27/005 5/484
5,638,562 A * 6/1997 Masoncup ..... A47G 9/0246 5/482
5,794,285 A * 8/1998 Burch ..... A47G 9/02 5/494
5,966,759 A * 10/1999 Sanders ..... A47C 27/007 5/497
6,618,880 B1 * 9/2003 Chase ..... A47C 21/026 5/484
2012/0117728 A1 * 5/2012 O'Neill ..... A47C 31/007 5/499
2016/0353907 A1 * 12/2016 Lava ..... A47C 31/105

* cited by examiner

*Primary Examiner* — Eric J Kurilla
(74) *Attorney, Agent, or Firm* — Alan D. Kamrath; Kamrath IP Lawfirm, P.A.

(57) ABSTRACT

A mattress protector includes an upper layer, a lower layer, a side layer linking edges of the upper and lower layers, and a plurality of joint members. The side layer has a top periphery and a bottom periphery, which abut the upper and lower layers, respectively. Each joint member deployed around the side layer is spaced from the top periphery of the side layer by a distinct distance. A section of the side layer can be double folded in a height direction for development of a first folding portion and a second folding portion. The mattress protector is able to tightly wrap a mattress featuring a distinct thickness when the joint members join the side layer to fix the first and second folding portions of the side layer. The present invention further provides a method to wrap a mattress with the mattress protector.

20 Claims, 13 Drawing Sheets

MATTRESS PROTECTOR AND METHOD TO WRAP A MATTRESS WITH THE SAME

BACKGROUND OF THE INVENTION

1. Field of the Invention

The present invention relates to a mattress protector and, more particularly, to a mattress protector for securely wrapping a mattress which features a distinct thickness.

2. Description of the Related Art

In general, a mattress is wrapped with a mattress protector (a bedspread or a bed blanket) because a smeared mattress is not cleaned easily and directly. To tightly wrap commercially available mattresses featuring different thicknesses (highness), a mattress protector should be manufactured for thicknesses of mattresses particularly. Against this background, a mattress protector is unavailable to all domestic mattresses with distinct specifications or models. In addition, a buyer who purchases a mattress protector needs to specify the thickness of a mattress; otherwise, a purchased mattress protector will not match realistic requirements.

FIG. 1 illustrates a conventional bedspread 10 which includes a cover layer 12 and a bed skirt 14 extending downward from a periphery of the cover layer 12. The bed skirt 14 is provided with elastic bands 16 sewed at four corners thereof, so that a mattress 18 can be tightly wrapped with the bed skirt 14 around the periphery of the mattress 18. However, the elastic bands 16 on the bedspread 10, which has been used for a period, are degraded and fail to tie up the mattress 18 and maintain flatness of a bed surface. Moreover, the thickness of the mattress 18 to be securely wrapped with the bedspread 10 should match the bedspread 10; otherwise, the mattress 18 is difficulty wrapped with the bedspread 10 or the bedspread 10 over the mattress 18 will be loose.

BRIEF SUMMARY OF THE INVENTION

Thus, an objective of the present invention is to provide a mattress protector which is used to tightly wrap mattresses featuring distinct thicknesses for effects of universality and interchangeability. Moreover, the present invention provides a method to tightly wrap a mattress featuring distinct thicknesses with the mattress protector.

To achieve this and other objectives, a mattress protector of the present invention includes an upper layer, a lower layer, and a side layer linking edges of the upper and lower layers. The side layer includes a top periphery and a bottom periphery spaced from the top periphery in a height direction of the side layer, with the top and bottom peripheries respectively abutting the upper and lower layers. The mattress protector further includes a plurality of first joint members provided on a circumference of the side layer. Each of the first joint members is spaced from the top periphery of the side layer in the height direction. A section of the side layer between the first joint members and the top periphery in the height direction is capable of being relatively folded for development of a first folding portion and a second folding portion. The first and second folding portions are connected to each other with the first joint members engaged on the side layer, so that the mattress protector is adapted to tightly wrap a mattress featuring a distinct thickness.

The present invention also provides a method to wrap a mattress with the mattress protector which comprises providing a mattress protector which includes an upper layer, a lower layer, a side layer linking edges of the upper and lower layers, and a plurality of first joint members, with the side layer including a top periphery and a bottom periphery spaced from the top periphery in a height direction of the side layer, with the top and bottom peripheries respectively abutting the upper and lower layers, with the first joint members provided on a circumference of the side layer, with each of the first joint members spaced from the top periphery of the side layer in the height direction; placing a mattress in the mattress protector, with a top surface, a bottom surface and a peripheral surface of the mattress respectively wrapped with the upper layer, the lower layer and the side layer of the mattress protector; folding a section of the side layer between the first joint members and the top periphery or the bottom periphery in the height direction for development of a first folding portion and a second folding portion, with the first joint members provided on the first folding portion; and engaging the first joint members with the side layer to fix the first and second folding portions.

In a preferred form, a protrudent edge portion is designed along the circumference of the side layer and between the top and bottom peripheries of the side layer, with the first joint members located above or below the protrudent edge portion in the height direction.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

A mattress protector 20 according to a first embodiment of the present invention is shown in FIGS. 2 through 7 of the drawings and is used to securely wrap a mattress 22, particularly a commercially available mattress 22 with a distinct thickness (height) for flatness of a bed surface and the mattress protector 20 neither slippery nor loose.

Figure 1:
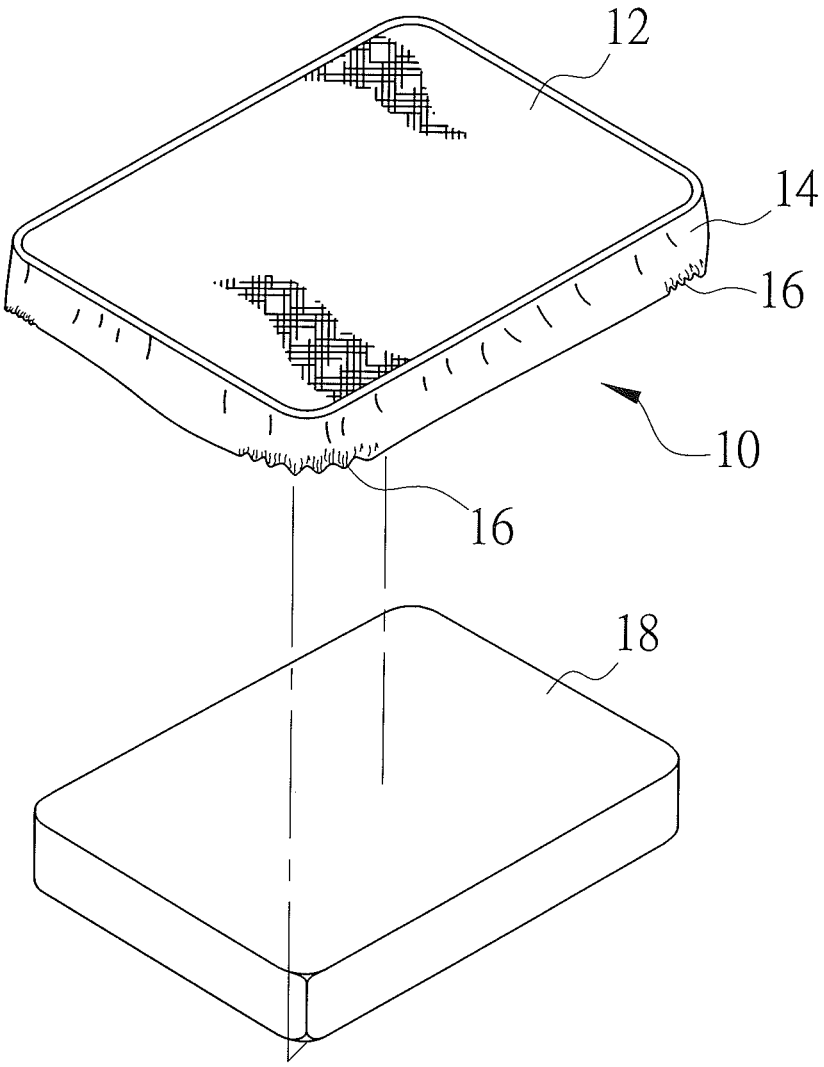
FIG.1 Prior Art
FIG. 1 is a schematic view of a conventional bedspread and a mattress.
Figure 2:
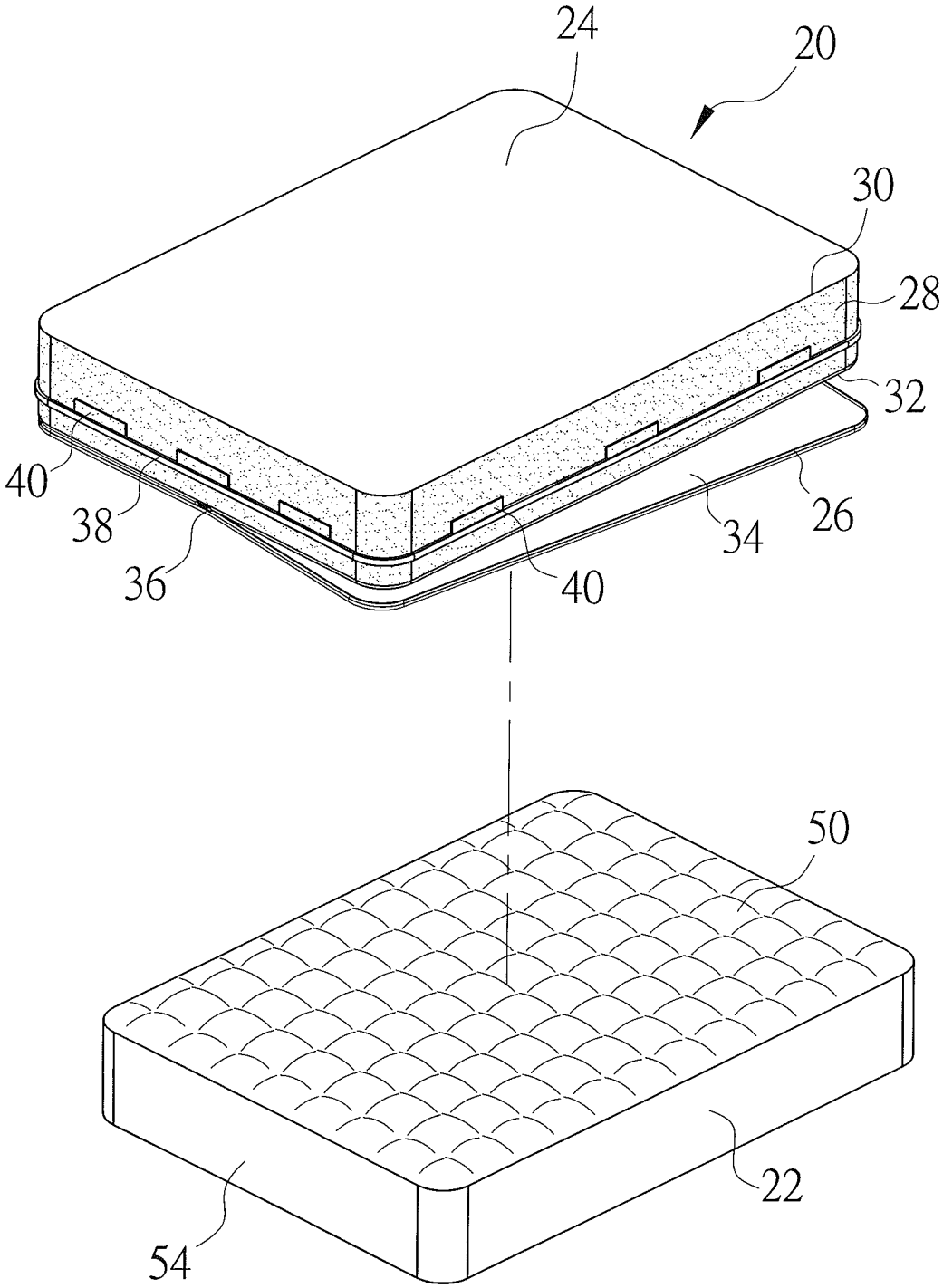
FIG. 2 is a perspective view of a mattress protector in a first embodiment of the present invention and a mattress.
Figure 3:
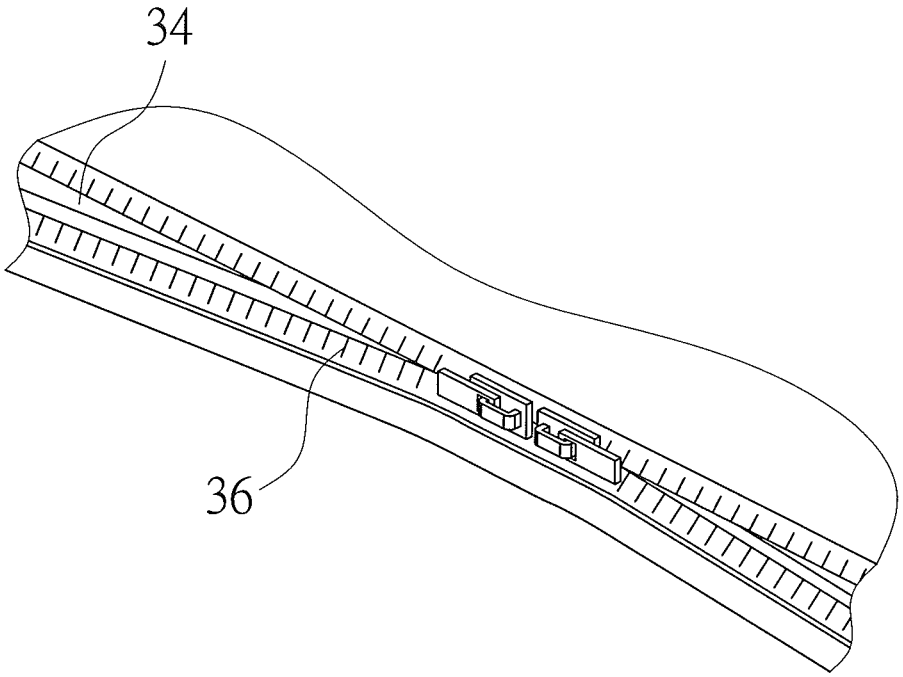
FIG. 3 is a partial, schematic view of the mattress protector in FIG. 2, illustrating zippers and an opening of the mattress protector.
Figure 4:
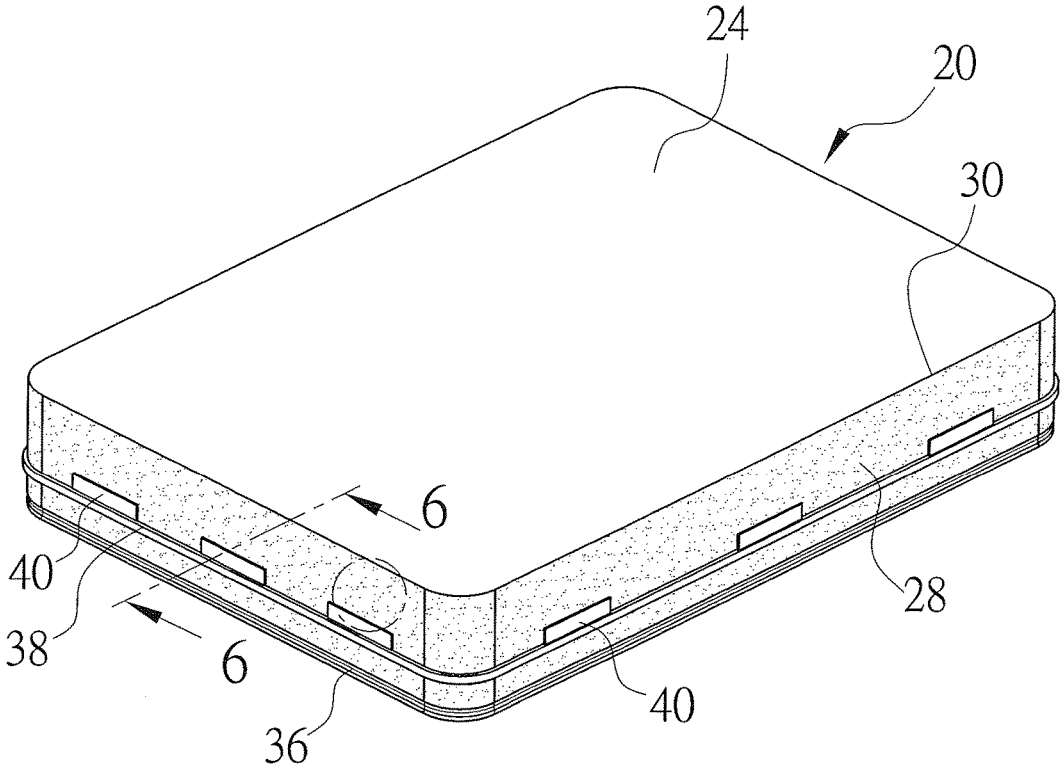
FIG. 4 shows a perspective view of the mattress protector in FIG. 2 in which the mattress is received.
Figure 5:
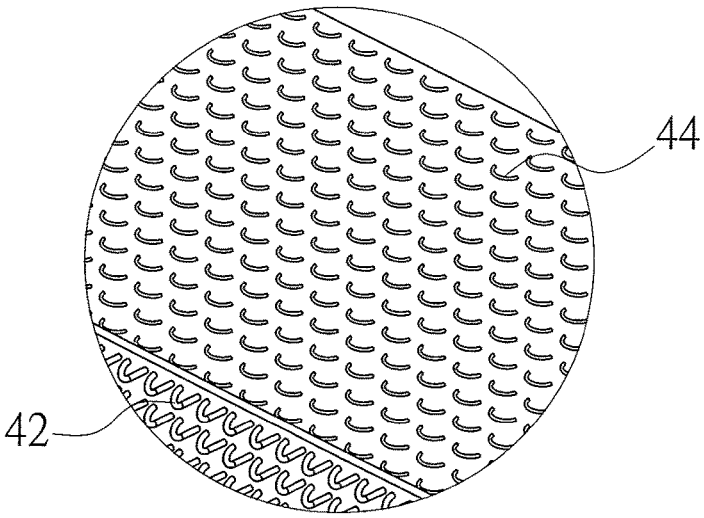
FIG. 5 shows an enlarged view of a circled portion in FIG. 4.

The mattress protector 20 includes an upper layer (bed surface layer) 24, a lower layer 26, and a side layer 28 linking edges of the upper and lower layers 24 and 26. Preferably, the upper and lower layers 24 and 26 are made of fabrics. The side layer 28 includes a top periphery 30 and a bottom periphery 32 spaced from the top periphery 30 in a height direction of the side layer 28, and the top and bottom peripheries 30 and 32 respectively abut the upper and lower layers 24 and 26. The mattress protector 20 further includes an opening 34 from which the mattress 22 can be placed in the mattress protector 20. At the opening 34 is provided with a zipper 36 by which the opening 34 is controllably opened or closed (FIG. 3). In this embodiment, the opening 34 is revealed along the bottom periphery 32 of the side layer 28; in another embodiment, the opening 34 can be provided along the top periphery 30 of the side layer 28. Furthermore, a protrudent edge portion 38 is designed along the circumference of the side layer 28 and between the top periphery 30 and the bottom periphery 32 of the side layer 28. In this embodiment, the side layer 28 is partially folded and stitched for development of the protrudent edge portion 38, as shown in FIG. 6.

The mattress protector 20 further includes a plurality of first joint members 40. In this embodiment, each of the first joint members 40 is a fastener with a plurality of hook portions 42 at both sides thereof (see FIG. 5, which illustrates a fastener with hook sides at the front and back). An outer surface of the side layer 28 is provided with a plurality of loop portions 44 which correspondingly combine the hook portions 42, that is, the side layer 28 consists of fasteners with loop sides. With the hook portions 42 and the loop portions 44 fastening each other, each of the first joint members 40 can be detachably engaged on the side layer 28. In a feasible embodiment, each of the first joint members 40 is a fastener with loop portions at two sides thereof, and the side layer 28 consists of fasteners with hook portions, so that each of the first joint members 40 is detachably engaged on the side layer 28.

The first joint members 40 spaced from one another are deployed along a circumference of the side layer 28 and located above the protrudent edge portion 38. Preferably, the first joint members 40 are accordant to the side layer 28 in height. Further, each of the first joint members 40 is spaced from the top periphery 30 (or the bottom periphery 32) of the side layer 28 by a distinct distance, so that a section of the side layer 28 between the first joint members 40 and the top periphery 30 (or the bottom periphery 32) of the side layer 28 can be relatively folded for development of a first folding portion 46 and a second folding portion 48 (see FIG. 7). With the hook portions 42 on an outer side of each first joint member 40 on the first folding portion 46 joining the loop portions 44 of the second folding portion 48, the first and second folding portions 46 and 48 are connected to each other. In a feasible embodiment, the first joint members 40 are located below the protrudent edge portion 38. However, the first joint members 40 deployed above the protrudent edge portion 38 avoids a shift of the upper layer 24 of the mattress protector 20 and stabilizes the mattress protector 20 to securely wrap the mattress 22 when the section of the side layer 28 between the first joint members 40 and the top periphery 30 is double folded.

Figure 6:
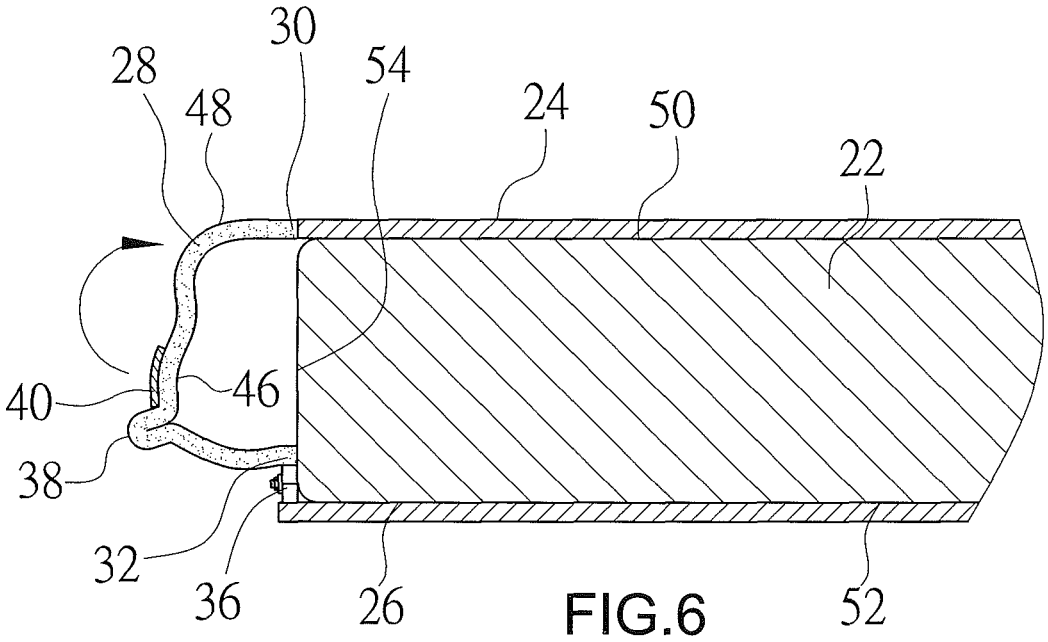
FIG. 6 shows a partial, sectional view of the mattress protector and the mattress according to section line 6-6 of FIG. 4, illustrating a height of a side layer of the mattress protector is greater than a thickness of the mattress.
Figure 7:
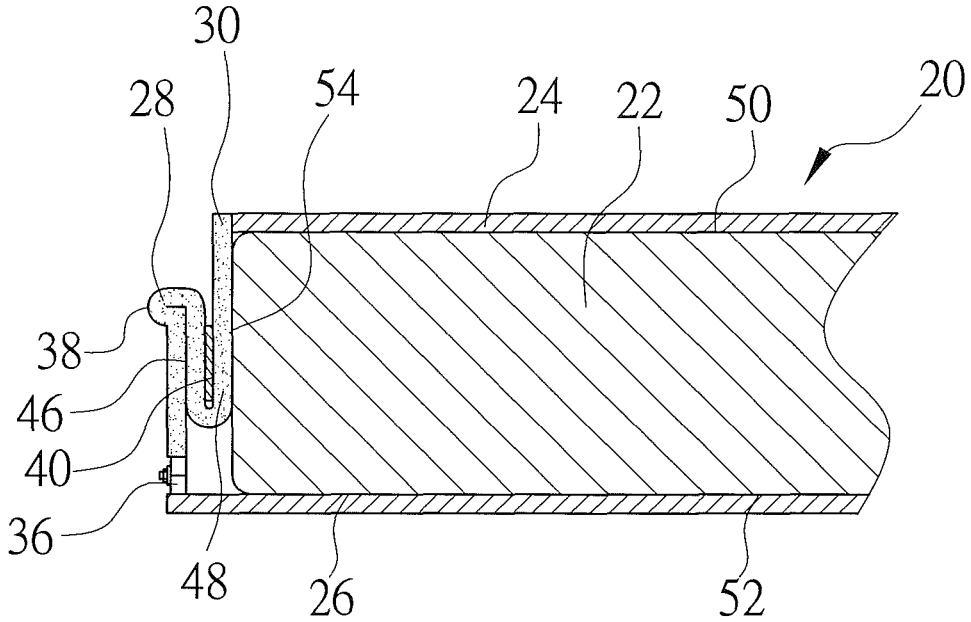
FIG. 7 shows a sectional view similar to FIG. 6, with a section of the side layer double folded for development of two folding portions which are fixed for a changeable height of the side layer.

The present invention further provides a method to wrap a mattress, which includes providing the mattress protector 20 and placing a mattress 22 in the mattress protector 20 with a top surface 50, a bottom surface 52 and a peripheral surface 54 of the mattress 22 respectively wrapped by the upper layer 24, the lower layer 26 and the side layer 28 of the mattress protector 20, and with four corners of the mattress protector 20 aligned with four corners of the mattress 22 (FIG. 6). Then, a section of the side layer 28 between the first joint members 40 and the top periphery 30 in the height direction of the side layer 28 are relatively folded for development of the first and second folding portions 46 and 48, both of which can be securely fixed to each other with the first joint members 40 at the first folding portion 46 joining the second folding portion 48 (FIG. 7). In this method, the height of the side layer 28 of the mattress protector 20 is selected to match a commercially available mattress with a larger thickness. As such, the mattress protector 20 is able to tightly wrap either the mattress 22 having a corresponding thickness or another thinner mattress for secure wrapping effect.

The mattress protector 20 of the present invention, which matches a mattress's distinct thickness with the height of the side layer 28 adjusted, is characteristic of secure wrapping effect by which the mattress protector 20 covered on the mattress 22 keeps a smooth bed surface neither slippery nor loose. Moreover, the protrudent edge portion 38 contributes to double folding and linking the first and second folding portions 46, 48 conveniently. Specifically, the protrudent edge portion 38, which is a benchmark to double fold the first and second folding portions 46 and 48, can be gripped by a user double folding the first and second folding portions 46, 48 for easy adjustment of the side layer 28 in height. Furthermore, when the mattress protector 20 needs to be cleaned in a washing machine, each first joint member 40 (a fastener with a plurality of hook portions 42 at both sides), which is randomly and easily separated from as well as flexibly and repeatedly attached to the side layer 28, can be removed, and fabrics of the upper layer 24 or the lower layer 26 are not wound by a hook side on the two-sided fastener for easy cleaning.

Figure 8:
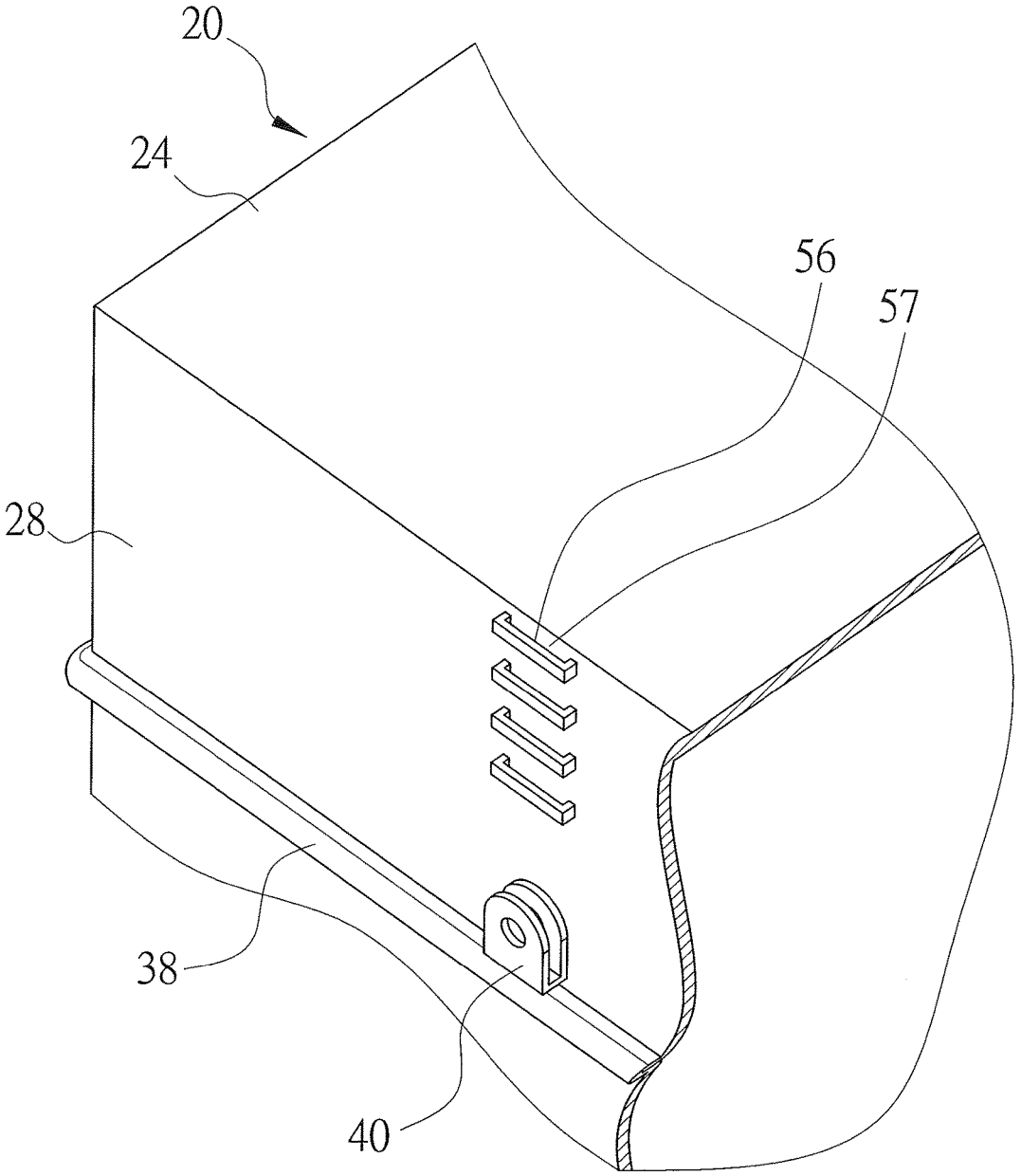
FIG. 8 is a partial, perspective view of a mattress protector in a second embodiment of the present invention.
Figure 9:
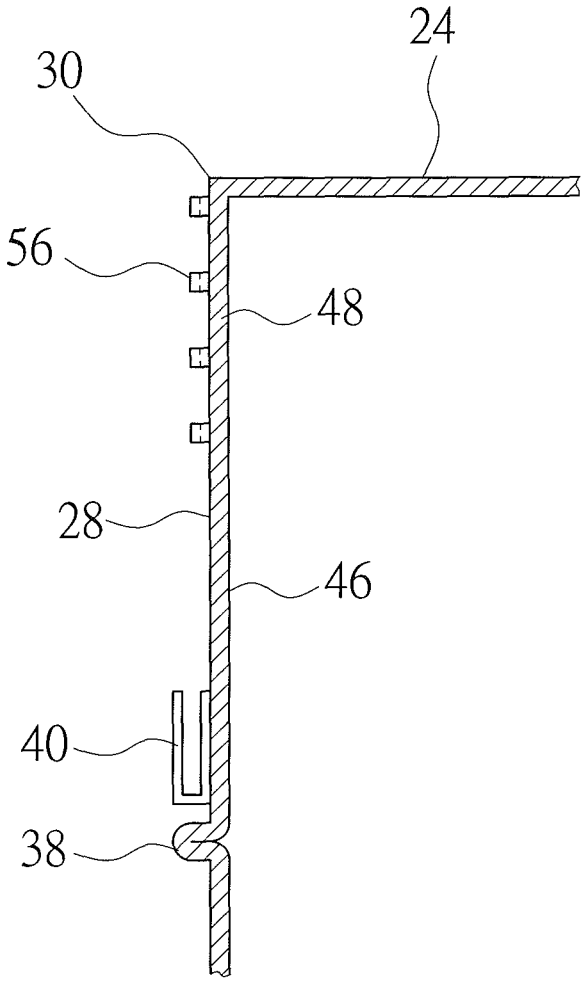
FIG. 9 shows a partial, sectional view of the mattress protector in FIG. 8.
Figure 10:
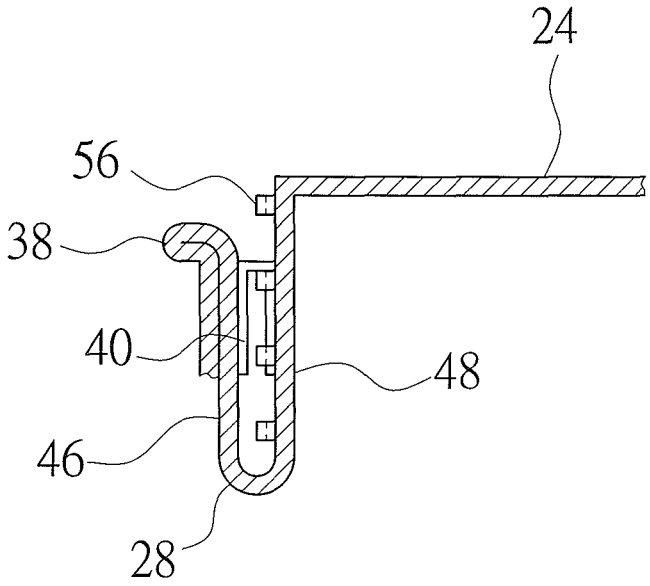
FIG. 10 is a sectional view similar to FIG. 9, with a section of the side layer double folded for development of two folding portions which are fixed for a changeable height of the side layer.

FIGS. 8 through 10 illustrate a mattress protector 20 in a second embodiment of the present invention. In this embodiment, a plurality of second joint members 56 is provided on an outer surface of the side layer 28 and above each first joint member 40, so that one of the second joint members 56 can be selected to join a corresponding first joint member 40. Each of the first joint members 40 and each of the second joint members 56 are a button-like male fastener and a female fastener with a buttonhole 57, respectively. Each first joint member 40 and a corresponding second joint member 56 will fasten each other to fix the first and second folding portions 46 and 48 which are developed with a section of the side layer 28 between the first joint members 40 and the top periphery 30 double folded. In addition, the side layer 28 of the mattress protector 20 in this embodiment is made of but not limited to fastening fabrics.

Figure 11:
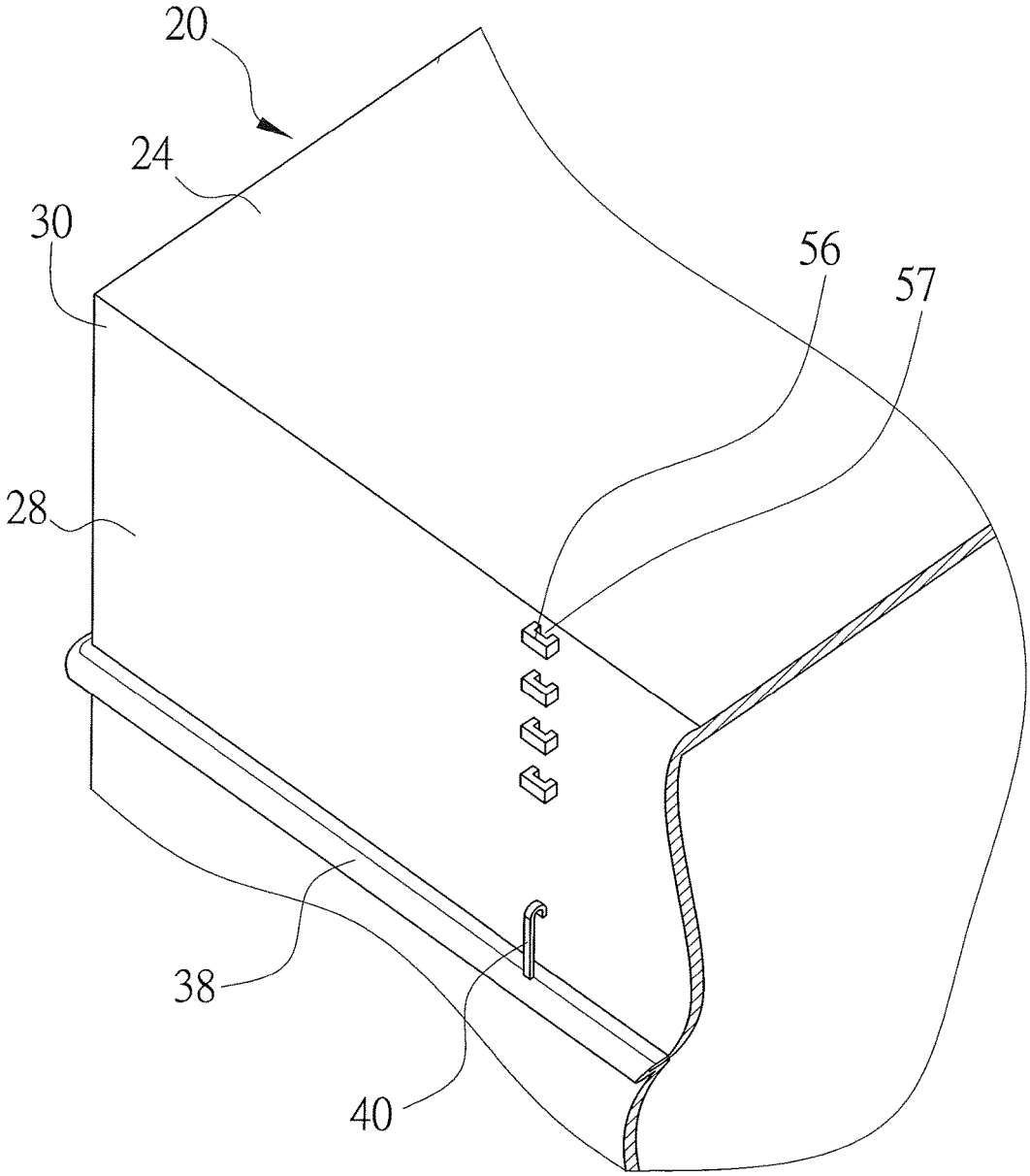
FIG. 11 is a partial, perspective view of a mattress protector in a third embodiment of the present invention.
Figure 12:
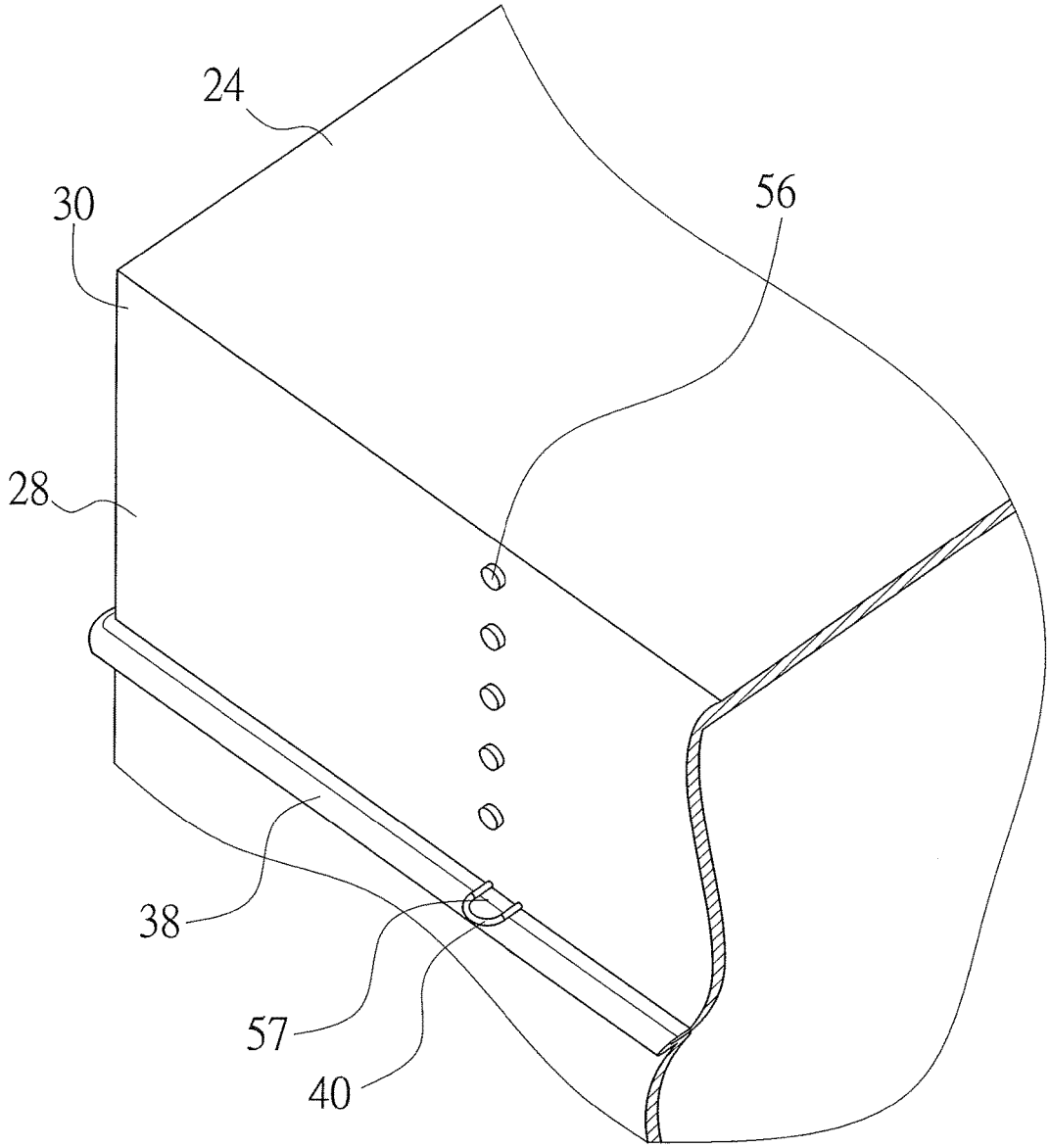
FIG. 12 is a partial, perspective view of a mattress protector in a fourth embodiment of the present invention.
Figure 13:
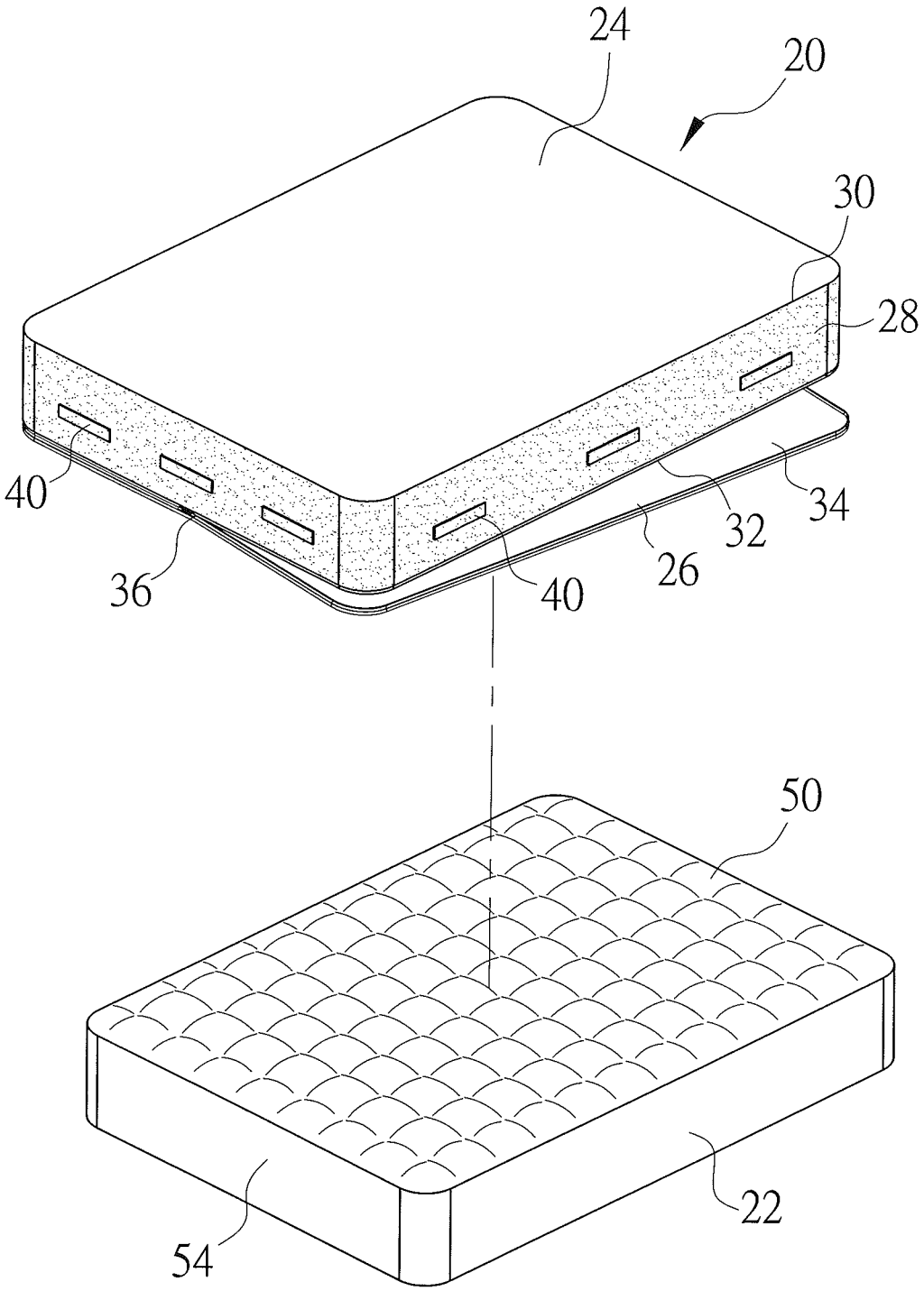
FIG. 13 is a perspective view of a mattress protector in a fifth embodiment of the present invention and a mattress.

FIG. 11 illustrates a mattress protector 20 in a third embodiment of the present invention. In this embodiment, each of the first joint members 40 and each of the second joint members 56 are a hook-like male fastener and a female fastener with a buttonhole 57, respectively. FIG. 12 illustrates a mattress protector 20 in a fourth embodiment of the present invention. In this embodiment, each of the second joint members 56 and each of the first joint members 40 are a button-like male fastener and a female fastener with a buttonhole 57, respectively. In another embodiment, the first and second joint members 40 and 56 can be other types of male and female fasteners or can be magnetic members joining each other by magnetism. FIG. 13 illustrates a mattress protector 20 in a fifth embodiment of the present invention. In this embodiment, the side layer 28 is provided with no protrudent edge portion 38.

Figure 14:
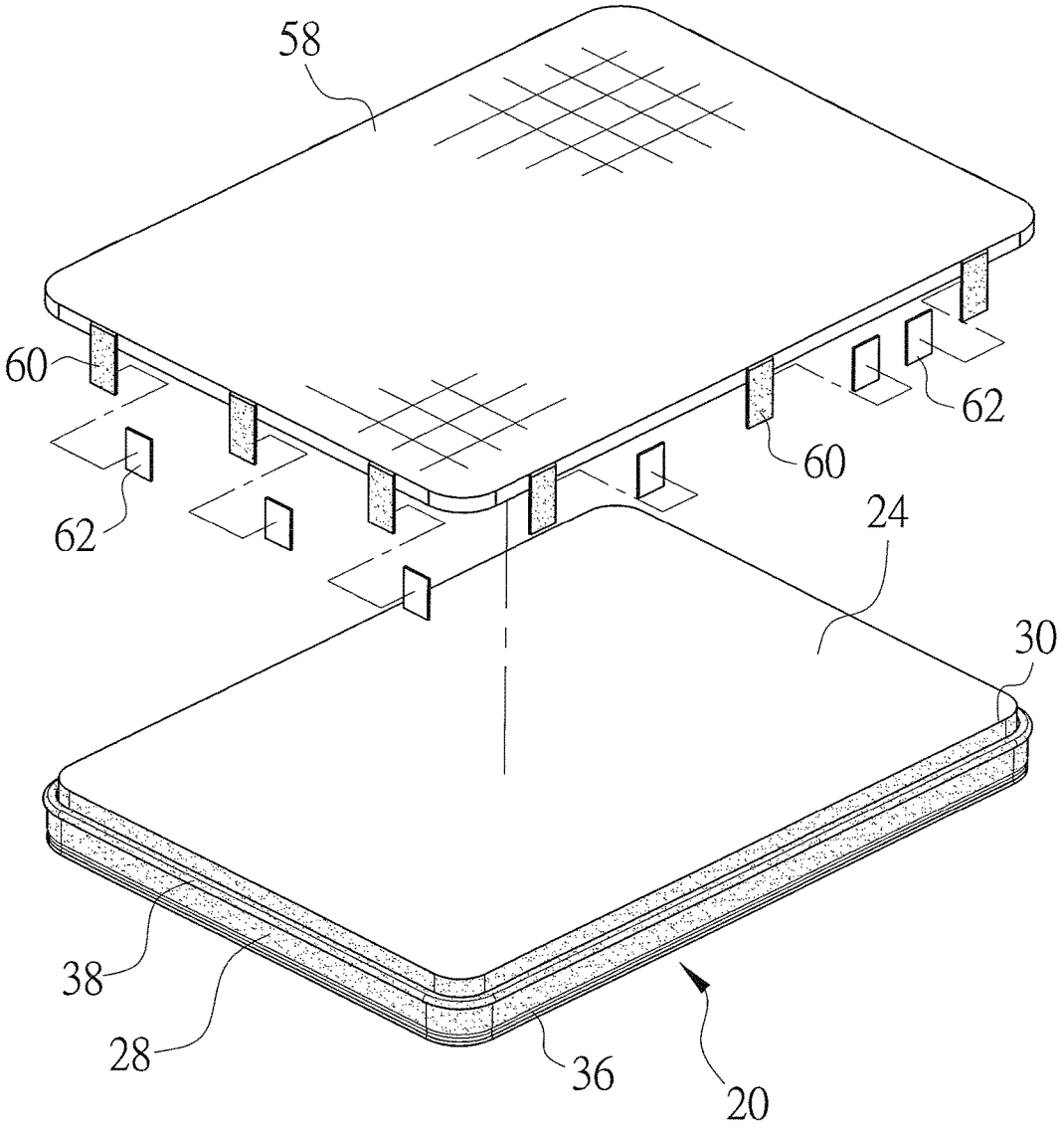
FIG. 14 is a perspective view which illustrates the mattress protector in FIG. 2 wrapping the mattress is combined with a sanitary mat.

FIG. 14 illustrates the mattress protector 20 of the present invention which is covered with a sanitary mat 58. A periphery of the sanitary mat 58 is provided with a plurality of spaced female fasteners 60 (fasteners with loop sides) and is integrated with the side layer 28 of the mattress protector 20 by a plurality of male fasteners (each of which is a fastener with hook sides at the front and back), so that the sanitary mat 58 is detachably attached to the mattress protector 20.

Figure 15:
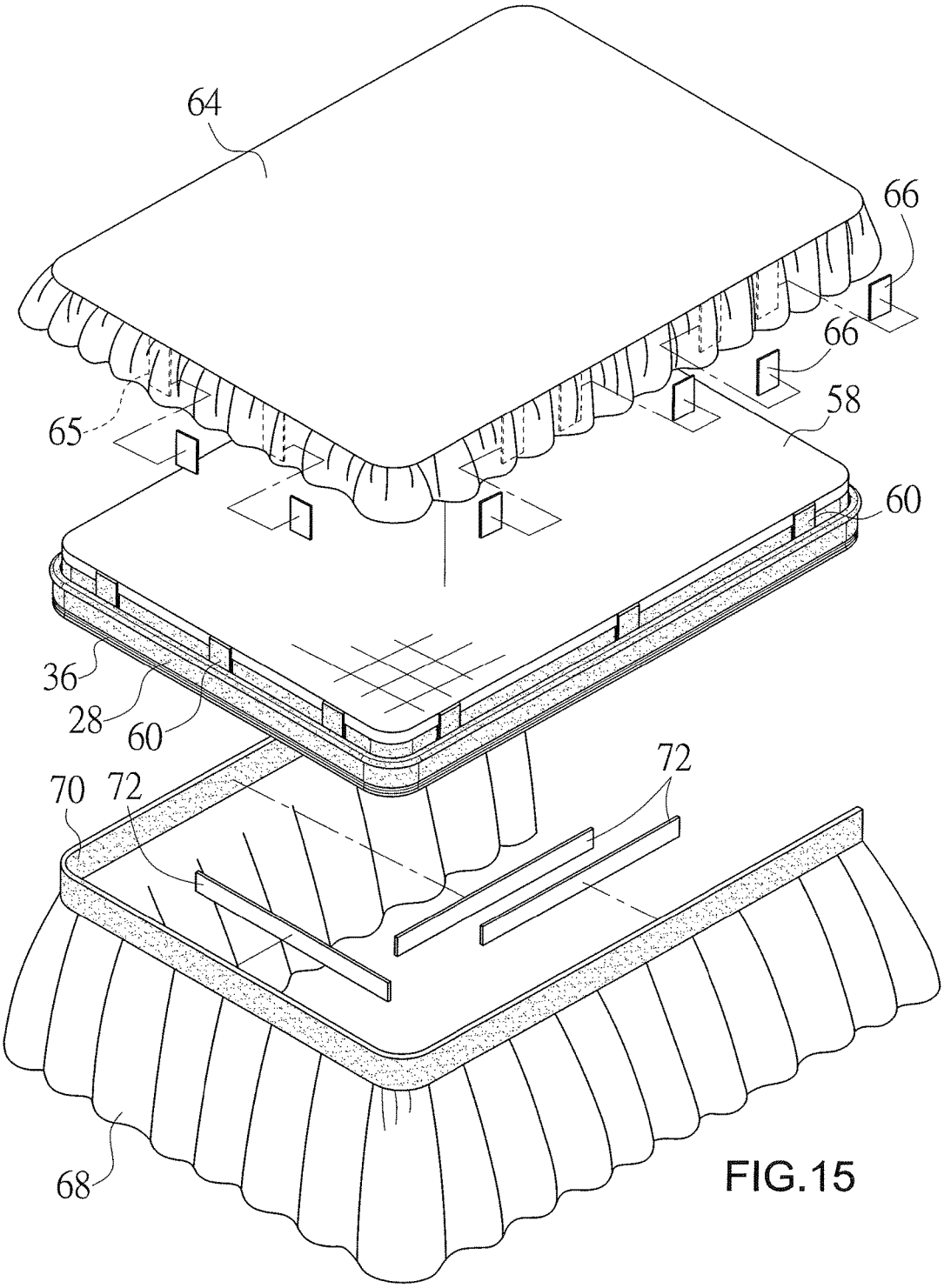
FIG. 15 is a perspective view which illustrates the sanitary mat in FIG. 14 joining the mattress protector with which a bedspread and a bed skirt are further combined.

FIG. 15 illustrates the mattress protector 20 of the present invention which matches the sanitary mat 58, a bedspread 64, and a bed skirt 68. The bedspread 64, which is provided with a plurality of spaced female fasteners 65 (fasteners with loop sides) along an internal periphery thereof, is detachably attached to the sanitary mat 58 with a plurality of spaced male fastener 66 (each of which is a fastener with hook sides at the front and back) joining the female fasteners 65 on the bedspread 64 and the female fasteners 60 on the sanitary mat 58. Furthermore, the bed skirt 68, which is provided with a female fastener 70 around an upper periphery thereof, is integrated with the side layer 28 of the mattress protector 20 by a plurality of male fasteners 72, so that the bed skirt 68 is detachably attached to the mattress protector 20 underneath. As such, the side layer 28 of the mattress protector 20 accordant to the thickness of a mattress for adjustment in height allows the sanitary mat 58, the bedspread 64 and the bed skirt 68, all of which rely on two-sided male fasteners detachably attached to the side layer 28, to be further added and to be removed and cleaned or installed without lifting the mattress for easy assembly and disassembly.

The scope of the invention is to be indicated by the appended claims, rather than by the foregoing description, and all changes which come within the meaning and range of equivalency of the claims are intended to be embraced therein.

The invention claimed is:

1. A mattress protector comprising:

an upper layer, a lower layer, and a side layer linking edges of the upper and lower layers, with the side layer including a top periphery and a bottom periphery spaced from the top periphery in a height direction of the side layer, with the top and bottom peripheries respectively abutting the upper and lower layers; and a plurality of first joint members provided on a circumference of the side layer, with each of the plurality of first joint members spaced from the top periphery of the side layer in the height direction, wherein a protrudent edge portion is designed along the circumference of the side layer and between the bottom periphery of the side layer and the plurality of first joint members in the height direction, wherein a section of the side layer between the protrudent edge portion and the top periphery in the height direction is capable of being relatively folded for development of a first folding portion abutting the protrudent edge portion and a second folding portion abutting the top periphery, with the plurality of first joint members located on the first folding portion;

wherein the first and second folding portions are connected to each other with the plurality of first joint members engaged on the side layer, so that the mattress protector is adapted to wrap a mattress featuring a distinct thickness.

2. The mattress protector according to claim 1, wherein the plurality of first joint members is adjacent to the protrudent edge portion in the height direction.

3. The mattress protector according to claim 1, wherein each of the plurality of first joint members is a fastener with a plurality of hook portions at both sides thereof, with the side layer is a fastener with loop portions.

4. The mattress protector according to claim 2, wherein each of the plurality of first joint members is a fastener with a plurality of hook portions at both sides thereof, with the side layer is a fastener with loop portions.

5. The mattress protector according to claim 1, wherein each of the plurality of first joint members is a fastener with loop portions at both sides thereof, with the side layer being a fastener with hook portions.

6. The mattress protector according to claim 2, wherein each of the plurality of first joint members is a fastener with loop portions at both sides thereof, with the side layer being a fastener with hook portions.

7. The mattress protector according to claim 1, wherein a plurality of second joint members is provided on an outer face of the side layer and located above each first joint member in the height direction, with one of the plurality of second joint members being selected to join a corresponding first joint member, with each of the plurality of first joint members being one of male and female fasteners, with each of the plurality of second joint members being another of the male and female fasteners.

8. The mattress protector according to claim 2, wherein a plurality of second joint members is provided on an outer face of the side layer and located above each first joint member in the height direction, with one of the plurality of second joint members being selected to join a corresponding first joint member, with each of the plurality of first joint members being one of male and female fasteners, with each of the plurality of second joint members being another of the male and female fasteners.

9. The mattress protector according to claim 1, wherein the side layer is partially folded and stitched for development of the protrudent edge portion.

10. The mattress protector according to claim 1, wherein the side layer is provided with a plurality of male fastener, with a sanitary mat, a bedspread, or a bed skirt detachably attached to the side layer by a plurality of female fasteners.

11. A method to wrap a mattress, comprising:

providing a mattress protector which includes an upper layer, a lower layer, a side layer linking edges of the upper and lower layers, and a plurality of first joint members, with the side layer including a top periphery and a bottom periphery spaced from the top periphery in a height direction of the side layer, with the top and bottom peripheries respectively abutting the upper and lower layers, with the first joint members provided on a circumference of the side layer, with each of the plurality of first joint members spaced from the top periphery of the side layer in the height direction, wherein a protrudent edge portion is designed along the circumference of the side layer and between the bottom periphery of the side layer and the plurality of first joint members in the height direction;

placing a mattress in the mattress protector, with a top surface, a bottom surface and a peripheral surface of the mattress respectively wrapped with the upper layer, the lower layer and the side layer of the mattress protector;

folding a section of the side layer between the protrudent edge portion and the top periphery in the height direction for development of a first folding portion abutting the protrudent edge portion and a second folding portion abutting the top periphery, with the plurality of first joint members provided on the first folding portion; and engaging the plurality of first joint members with the side layer to fix the first and second folding portions.

12. The method to wrap a mattress according to claim 11, wherein the plurality of first joint members is adjacent to the protrudent edge portion in the height direction.

13. The method to wrap a mattress according to claim 11, wherein each of the plurality of first joint members is a fastener with a plurality of hook portions at both sides thereof, with the side layer is a fastener with loop portions.

14. The method to wrap a mattress according to claim 12, wherein each of the plurality of first joint members is a fastener with a plurality of hook portions at both sides thereof, with the side layer is a fastener with loop portions.

15. The method to wrap a mattress according to claim 11, wherein each of the plurality of first joint members is a fastener with loop portions at both sides thereof, with the side layer being a fastener with hook portions.

16. The method to wrap a mattress according to claim 12, wherein each of the plurality of first joint members is a fastener with loop portions at both sides thereof, with the side layer being a fastener with hook portions.

17. The method to wrap a mattress according to claim 11, wherein a plurality of second joint members is provided on an outer face of the side layer and located above each first joint member in the height direction, with one of the plurality of second joint members being selected to join a corresponding first joint member, with each of the plurality of first joint members being one of male and female fasteners, with each of the plurality of second joint members being another of the male and female fasteners.

18. The method to wrap a mattress according to claim 12, wherein a plurality of second joint members is provided on the outer face of the side layer and located above each first joint member in the height direction, with one of the plurality of second joint members being selected to join a corresponding first joint member, with each of the plurality of first joint members being one of male and female fasteners, with each of the plurality of second joint members being another of the male and female fasteners.

19. The method to wrap a mattress according to claim 11, wherein the side layer is partially folded and stitched for development of the protrudent edge portion.

20. The method to wrap a mattress according to claim 11, wherein the side layer is provided with a plurality of male fastener, with a sanitary mat, a bedspread, or a bed skirt detachably attached to the side layer by a plurality of female fasteners.

* * * * *